United States Patent [19]

Franke, Sr.

[11] Patent Number: 4,577,792

[45] Date of Patent: Mar. 25, 1986

[54] ROBOTIC WORK FABRIC MANIPULATOR

[75] Inventor: John M. Franke, Sr., Glendale, Calif.

[73] Assignees: The Singer Company, Stamford, Conn.; AVG Productions, Inc., Valencia, Calif.

[21] Appl. No.: 719,096

[22] Filed: Apr. 2, 1985

[51] Int. Cl.[4] ..... B65H 20/22

[52] U.S. Cl. ..... 226/162; 112/147; 226/62; 226/67; 226/158

[58] Field of Search ..... 226/89, 91, 122, 125, 226/158, 162–167, 141, 149, 52, 53, 62, 67, 93, 94, 95, 96; 227/24, 30, 37, 152; 112/147, 148, 303

[56] References Cited

U.S. PATENT DOCUMENTS

| | | | |
|---|---|---|---|
| 3,486,676 | 12/1969 | Bruns | 226/149 |
| 4,059.212 | 11/1977 | Ledgerwood | 226/141 |
| 4,333,593 | 6/1982 | Bihler et al. | 226/122 |
| 4,360,140 | 11/1982 | Morris | 226/162 |

*Primary Examiner*—Stanley N. Gilreath

*Attorney, Agent, or Firm*—Robert E. Smith; Edward L. Bell

[57] ABSTRACT

A robotic end effector adapted to grip a fabric ply at a point remote from a free edge portion of the ply and a fabric edge influencing element resiliently supported from the end effector is provided to minimize distortion of the free edge portion of the fabric ply.

5 Claims, 6 Drawing Figures

ROBOTIC WORK FABRIC MANIPULATOR

DESCRIPTION

BACKGROUND OF THE INVENTION

This invention relates to devices for engaging and manipulating one or more plies of fabric in a robotically controlled operation such as folding, sewing, or the like. More particularly, this invention relates to robotic fabric engaging and manipulating devices which are required to present a free edge portion of a fabric ply into a constricted opening as, for instance, the mouth of a fabric folder, beneath an elevated sewing machine presser foot, or the like.

DESCRIPTION OF THE PRIOR ART

Introduction of the fabric edge portion into constricted openings has been facilitated in the prior art by providing flaired surfaces leading to the constricted opening as shown in my U.S. patent application Ser. No. 611,240, filed May 17, 1984, now U.S. Pat. No. 4,517,907. Such flaired mouth arrangements provide a generally acceptable degree of effectiveness where the fabric is introduced by a human operator since there is rarely any impediment to human operators making a myriad of changes in their grip or engagement with the fabric ply so that diviation from desired fabric orientation is continuously correctable.

In robotic work fabric manipulation, however, changes in the position of engagement of the work gripping means with the work ply are deleterious to the accuracy of work manipulation. In robotic environment, therefore, positive grip of a work fabric can be maintained no closer to the fabric edge than can be tolerated at any time throughout the fabric manipulating operation. As a result, in robotics, flaired guide mouths and the like are only effective to correct slight deviations from ideal fabric edge orientations.

SUMMARY OF THE INVENTION

It is an object of this invention to provide a novel and effective supplement to a conventional robotic fabric ply gripping manipulator for maintaining the free edge of the fabric in a predetermined orientation. This object of the invention is attained by the provision of a smooth fabric edge retaining element which is resiliently supported adjacent the robotic fabric ply gripping manipulator to overlie the free fabric edge with capacity to be shifted away from the free fabric edge upon contact with any other guide, device, or mechanism.

DESCRIPTION OF THE DRAWINGS

With the above and additional objects and advantages in view as will hereinafter appear, this invention will be described hereinbelow with reference to the accompanying drawings of a preferred embodiment in which:

FIGS. 3A, 3B and 3C are enlarged cross sectional views taken substantially along line 3—3 of FIG. 1, and showing a sequence of positions of the parts as the fabric manipulating device of the invention serves to introduce a fabric edge portion into a constricted mouth of a fabric folder or the like.

DETAILED DESCRIPTION OF THE INVENTION

Figure 1:
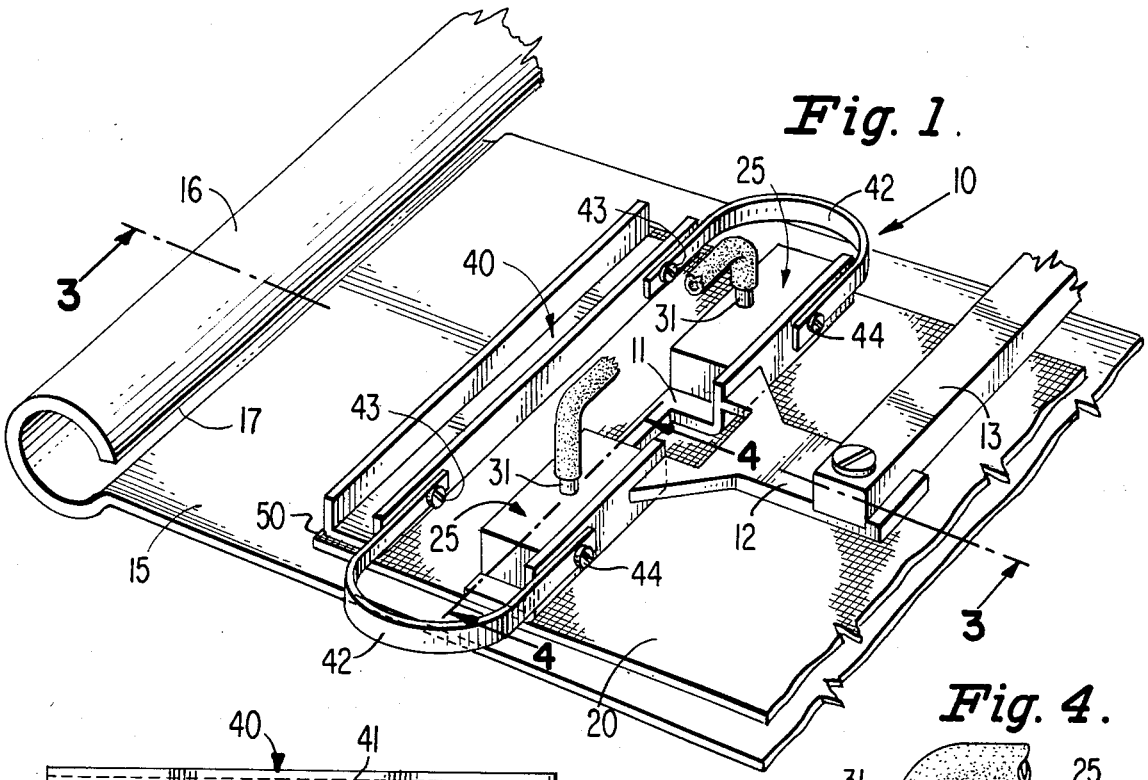
FIG. 1 is a perspective view of a robotic fabric manipulating device having this invention applied thereto and showing the device gripping a work fabric in a position remote from the mouth of a fabric folder into which the gripped fabric is to be inserted.
Figure 2:
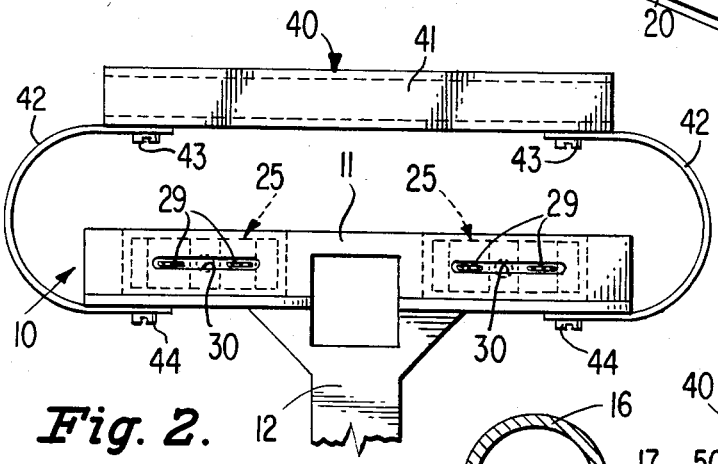
FIG. 2 is a bottom view of the fabric gripping device of FIG. 1.

In FIG. 1 a robotic fabric manipulating device is indicated generally at 10 and includes a work engaging shoe 11 from which a support bracket 12 extends. Indicated at 13 are connections to the support bracket 12 by which the fabric manipulating device 10 may be shifted. Any known robotic shifting arrangement (not shown) may be utilized to shift the shoe 11 of the device in any direction.

Figure 4:
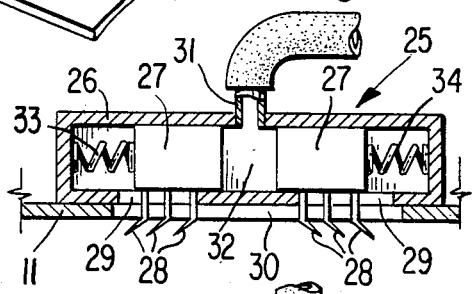
FIG. 4 is an enlarged cross sectional view of a fabric gripping assembly taken substantially along line 4—4 of FIG. 1.

In FIG. 1, 15 indicates a planar work supporting platform to which is secured a hollow tube 16 having a lengthwise slot 17 arranged flush with the top of the work supporting platform 15. The tube 16 is representative of any of a wide variety of fabric influencing devices such as work folders, etc., which present a narrow constricted mouth into which a fabric panel edge is required to be introduced. For a detailed disclosure and description of such a work folder, reference is made to my U.S. Pat. No. 4,553,745, Nov. 19, 1985, for FABRIC CLAMPING MEANS FOR DRIVEN WORK FOLDER The fabric manipulating device 10 shown in FIG. 1 includes on the shoe 11 a means for gripping a ply of work fabric 20, and it is important in robotic control of fabric manipulation that the grip of the fabric ply be maintained without interruption during the entire work manipulating cycle of the device in order that known orientations of the fabric be preserved. To this end two fabric gripping assemblies 25 are secured one adjacent each extremity of the shoe 11. The fabric gripping assemblies 25 may be identical and, as shown in FIG. 4, each includes a housing shell 26 within which two slide blocks 27, 27 are shiftable, each slide block 27 having oppositely inclined sharpened pins 28 projecting therefrom for engagement with the fabric panel through aligned slots 29, 30 in the housing shell 26 and shoe 11. An air hose fitting 31 carried by the shell 26 is provided to admit air under pressure to the space 32 between the slide blocks urging the blocks apart. Return springs 33, 34 serve to return the blocks upon relief of air pressure in the space 32.

It will be understood that the invention may be used with a fabric manipulating device having any of a wide variety of known fabric gripping means; the fabric gripping assembly described above is included herein by way of example and not intended as a limitation of the scope of this invention.

In those instances in which an edge portion of a fabric panel must be operated upon by instrumentalities other than the robotic fabric manipulating device 10 as, for instance, if the fabric edge must be folded, subjected to the action of a sewing machine, or the like, it is necessary that the positive fabric gripping portion of the robotic fabric manipulating device be positioned sufficiently remote from the fabric panel edge to be operated upon as to provide sufficient free fabric to accommodate the operation.

As heretofore constituted, fabric gripping devices left a fabric ply edge portion extending therefrom free of control by the fabric gripping device other than that provided by the inherent rigidity of the particular fabric and the platform on which the fabric was shifted.

Numerous factors can be present capable of acting to shift the uncontrolled free fabric edge portion from a preferred disposition flat against the supporting platform, such as exhaust air from pneumatic controls, the rapid movement typical of robotic controls, etc.

For providing control of the free fabric edge, this invention includes a fabric edge overlying element 40 resiliently supported relatively to the work engaging shoe 11 with capacity for deflection out of interference with work folder guides, sewing machine parts or the like with which the free fabric edge is required to be operated upon.

As illustrated in the accompanying drawings, a particularly simple and effective embodiment of the invention may be provided by a channel-shaped fabric edge overlying element 40 having a smooth polished underside 41 supported by a pair of arched flat spring strips 42—42 each secured by rivets 43 to the element 40 and by rivets 44 to the work engaging shoe 11.

Figure 3A:
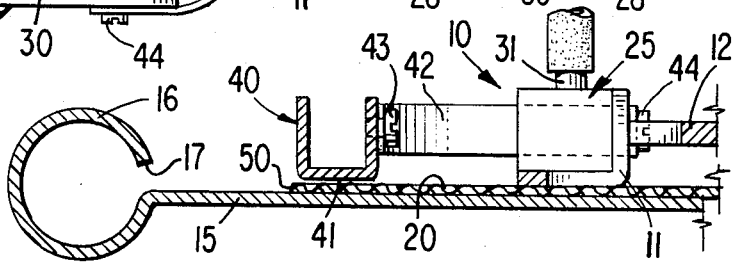
Figure 3B:
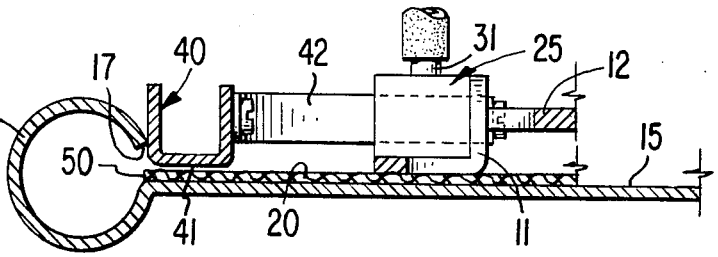
Figure 3C:
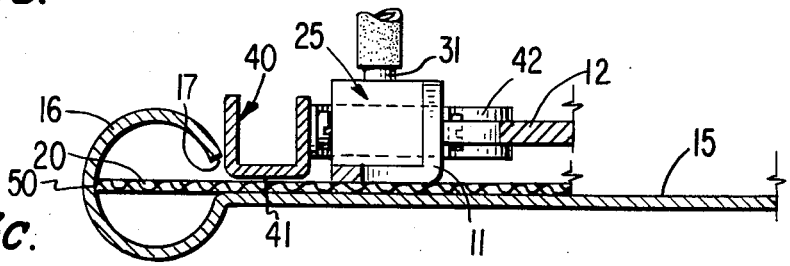

Preferably, the spring strips 42—42 are formed and dimensioned so as to support the element 40 substantially contiguous to the free edge 50 of the fabric panel 20 when the work engaging shoe 11 is in gripping relation with the fabric as shown in FIGS. 1 and 3A. Moreover, the spring strips 42—42 are secured to the shoe 11 and the element 40 such that the element is supported with its smooth polished underside slightly elevated above the fabric panel as shown in FIGS. 3A, 3B and 3C. When the shoe transports the fabric panel onto the platform 15, the element 40 thus influences the fabric panel edge 50 into a flat disposition on the platform 15 without gripping the fabric panel and without impeding transport of the fabric panel free edge in response to movement of the work gripping shoe 11.

With this control exerted on the fabric panel, the fabric panel edge 50 may be directed to the constricted opening 17 of a work folder or the like in perfect alignment with the constricted opening as illustrated in FIG. 3B.

As illustrated in FIG. 3C, continued movement of the work engaging shoe 11 toward the folder 16 causes the free edge 50 of the fabric to be shifted through the constricted opening 17 and the element 40 does not interfere with such fabric edge insertion since the element 40 is not pressed in engagement with the fabric panel and the spring strips 42—42 provide resilient support for the element 40 to be shifted toward the work engaging shoe upon engagement of the element 40 with the folder.

It will be appreciated that the specific form of the fabric edge overlying element and the resilient support for the element from the work engaging shoe 11 may be varied. In cases where devices in accordance with this invention are intended to cooperate with particular work folders, particular sewing machines or the like, the specific form may be chosen to be especially compatibile therewith and may be designed so that the fabric edge overlying element is deflected in a particular manner upon contact with the folder, for instance, so as to be deflected upwardly away from the fabric panel permitting the work engaging shoe to move closer to the folder.

Having set forth the nature of this invention what is claimed herein is:

1. In a fabric manipulating device for performing a robotic fabric handling operation including a fabric engaging shoe having a fabric engaging sole plate, means for gripping a ply of fabric against said sole plate, and means for shifting said fabric engaging shoe relatively to a fabric supporting platform, means for directing the free edge of a fabric ply extending from said fabric engaging shoe into the constricted mouth of a fabric influencing folder or the like comprising:

a fabric depressing element, means carried by said fabric engaging shoe for supporting said fabric depressing element above the free edge of a fabric ply extending from said fabric engaging shoe on said fabric supporting platform, and biasing means extending between said fabric depressing element and said fabric engaging shoe accomodating movement of said fabric depressing element toward and away from said fabric engaging shoe.

2. In a fabric manipulating device as set forth in claim 1 in which said supporting means and said biasing means for said fabric depressing element comprise bowed flat leaf spring means secured to said fabric depressing element and to said fabric engaging shoe and arranged substantially parallel to said fabric supporting platform.

3. In a fabric manipulating device as set forth in claim 1 in which said supporting means and said biasing means for said fabric depressing element comprises a pair of bowed flat leaf springs each secured at one extremity to said fabric depressing element and each secured at the opposite extremity to said fabric engaging shoe and each arranged substantially parallel to said fabric supporting platform.

4. A fabric manipulating device for performing a robotic fabric handling operation on a ply of fabric, said device comprising:

a fabric engaging shoe having a substantially planar sole plate, means on said fabric engaging shoe for gripping a ply of fabric against the sole plate of said fabric engaging shoe, means for influencing a free edge of a fabric ply extending from gripped relation against the sole plate of said fabric engaging shoe including a fabric depressing element having a smooth low friction fabric ply abutting sole plate, and resilient means extending between said fabric engaging shoe and said fabric depressing element, said resilient means supporting said fabric depressing element with the fabric ply abutting sole plate thereof substantially coplanar with the sole plate, and providing capacity for movement of said fabric depressing element toward and away from said fabric engaging shoe.

5. A fabric manipulating device as set forth in claim 4 wherein said resilient means extending between said fabric engaging shoe and said fabric depressing element comprises a pair of bowed leaf springs arranged in spaced relation to each other and substantially parallel to the plane containing the sole plates of said fabric engaging shoe and fabric depressing element.

* * * * *